US009854660B2

(12) United States Patent
Knoll

(10) Patent No.: US 9,854,660 B2
(45) Date of Patent: Dec. 26, 2017

(54) ION ACCELERATORS

(71) Applicants: THE UNIVERSITY OF SURREY, Guildford (GB); ASTRIUM LIMITED, Stevenage (GB)

(72) Inventor: Aaron Kombai Knoll, Guildford (GB)

(73) Assignees: ASTRIUM SAS, Suresnes (FR); ASTRIUM LIMITED, Hertfordshire (GB)

( * ) Notice: Subject to any disclaimer, the term of this patent is extended or adjusted under 35 U.S.C. 154(b) by 332 days.

(21) Appl. No.: 14/410,488

(22) PCT Filed: Jun. 18, 2013

(86) PCT No.: PCT/GB2013/051586
§ 371 (c)(1),
(2) Date: Dec. 22, 2014

(87) PCT Pub. No.: WO2013/190285
PCT Pub. Date: Dec. 27, 2013

(65) Prior Publication Data

US 2015/0373826 A1 Dec. 24, 2015

(30) Foreign Application Priority Data

Jun. 21, 2012 (GB) ..... 1210994.8

(51) Int. Cl.
*H05H 5/02* (2006.01)
*F03H 1/00* (2006.01)
(Continued)

(52) U.S. Cl.
CPC ..... *H05H 5/02* (2013.01); *F03H 1/0037* (2013.01); *F03H 1/0068* (2013.01); *H01J 27/146* (2013.01); *H01J 27/205* (2013.01)

(58) Field of Classification Search
CPC ..... F03H 1/00; F03H 1/0006; F03H 1/0012; F03H 1/0018; F03H 1/0025;
(Continued)

(56) References Cited

U.S. PATENT DOCUMENTS 4,838,021 A * 6/1989 Beattie ..... F03H 1/0043 315/111.81
4,862,032 A 8/1989 Kaufman et al.
(Continued)

FOREIGN PATENT DOCUMENTS

JP 09-231911 A 9/1997

OTHER PUBLICATIONS

International Search Report (PCT/ISA/210) dated Oct. 24, 2013, by the European Patent Office as the International Searching Authority for International Application No. PCT/GB2013/051586.

*Primary Examiner* — William H Rodriguez
*Assistant Examiner* — William Breazeal
(74) *Attorney, Agent, or Firm* — Buchanan Ingersoll & Rooney PC

(57) ABSTRACT

An ion accelerator includes: an inner magnet having a channel extending through it in an axial direction; an outer magnet extending around the inner magnet, the magnets having like polarities so as to produce a magnetic field having two locations of zero magnetic field strength. The locations are spaced apart in the axial direction; and an anode and a cathode are arranged to generate an electrical potential difference between the locations.

13 Claims, 3 Drawing Sheets

(51) Int. Cl.
*H01J 27/14* (2006.01)
*H01J 27/20* (2006.01)

(58) Field of Classification Search
CPC .... F03H 1/0031; F03H 1/0037; F03H 1/0043; F03H 1/005; F03H 1/0056; F03H 1/0062; F03H 1/0068; F03H 1/0075; F03H 1/0081; F03H 1/0087; F03H 1/0093; H01J 27/02; H01J 27/022; H01J 27/026; H01J 27/028; H01J 27/04; H01J 27/08; H01J 27/10; H01J 27/14; H01J 27/146
See application file for complete search history.

(56) References Cited

U.S. PATENT DOCUMENTS

| | | | | |
|---|---|---|---|---|
| 5,482,611 | A | 1/1996 | Helmer et al. | |
| 6,236,163 | B1 | 5/2001 | Maishev et al. | |
| 2003/0048053 | A1 | 3/2003 | Kornfeld et al. | |
| 2006/0138966 | A1* | 6/2006 | Kornfeld | B64G 1/405 315/111.61 |
| 2010/0107596 | A1* | 5/2010 | Kapulkin | F03H 1/0075 60/202 |

* cited by examiner

ION ACCELERATORS

FIELD OF THE INVENTION

The present invention relates to ion accelerators. Its primary application is in plasma thrusters, for example for use in the control of space probes and satellites, but it also has application in chemical vapour deposition (CVD), in lighting systems that require a source of plasma.

BACKGROUND TO THE INVENTION

Plasma thrusters are known which comprise a plasma chamber with an anode and a cathode which set up an electric field in the chamber, the cathode acting as a source of electrons. Magnets provide regions of high magnetic field in the chamber. A propellant, typically a noble gas, is introduced into the chamber. Electrons from the cathode are accelerated through the chamber, ionizing the propellant to form a plasma. Positive ions in the plasma are accelerated towards the cathode, which is at an open end of the chamber, while electrons are deflected and captured by the magnetic field, because of their higher charge/mass ratio. As more propellant is fed into the chamber the primary electrons from the cathode and the secondary electrons from the ionization process continue to ionize the propellant, projecting a continuous stream of ions from the open end of the thruster to produce thrust.

Examples of multi-stage plasma thrusters are described in US2003/0048053, and divergent cusped field (DCF) thrusters are also known.

SUMMARY OF THE INVENTION

The present invention provides an ion accelerator comprising a first magnet, which may be an inner magnet, and which may have a channel extending through it, for example in an axial direction, and second magnet, which may be an outer magnet, and may extend around the first magnet, the magnets having like polarities so as to produce a magnetic field having two locations of zero magnetic field strength. The locations may be spaced apart, for example in the axial direction. The accelerator may further comprise an anode and a cathode, which may be arranged to generate an electrical potential difference between the locations.

The channel may have a central axis. For example it may by cylindrical. The central axis may be an axis of rotational symmetry. One of the locations may be a line that extends around the central axis. One of the locations may be a point. The location that is a point may be forward of the other so that ions will tend to converge when moving between the locations.

One of the electrodes, which may be the anode, may be located radially between the inner and outer magnets. This electrode may include a tubular portion which may have an inner diameter greater than the outer diameter of the inner magnet, and an outer diameter less than the inner diameter of the outer magnet. One of the electrodes, which may be the cathode, may be located radially inside the inner magnet, and may be located on, or around, the central axis.

The channel may have an inlet end and an outlet end. These ends may be at respective poles of the inner magnet. The outer magnet may extend around at least a part of the inner magnet, and may have an inlet end and an outlet end, which may be at respective poles of the outer magnet. The inlet ends of the two magnets may be of like polarity. The magnets may be of annular cross section.

The accelerator may further comprise a housing which may be arranged to support either one or both of the magnets. The accelerator may further comprise a heat sink which may be thermally connected to any one or more of the inner and outer magnets and the housing.

The present invention further provides an ion thruster comprising an accelerator according to the invention and a propellant source arranged to feed propellant into the accelerator. The propellant source may be arranged to feed propellant to the cathode. Alternatively or in addition the propellant source may be arranged to feed propellant into a space between the inner and outer magnets.

The accelerator may include any one or more features, in any combination, of any one or more of the embodiments of the present invention which will now be described by way of example only with reference to the accompanying drawings.

DESCRIPTION OF THE PREFERRED EMBODIMENTS

Figure 1:
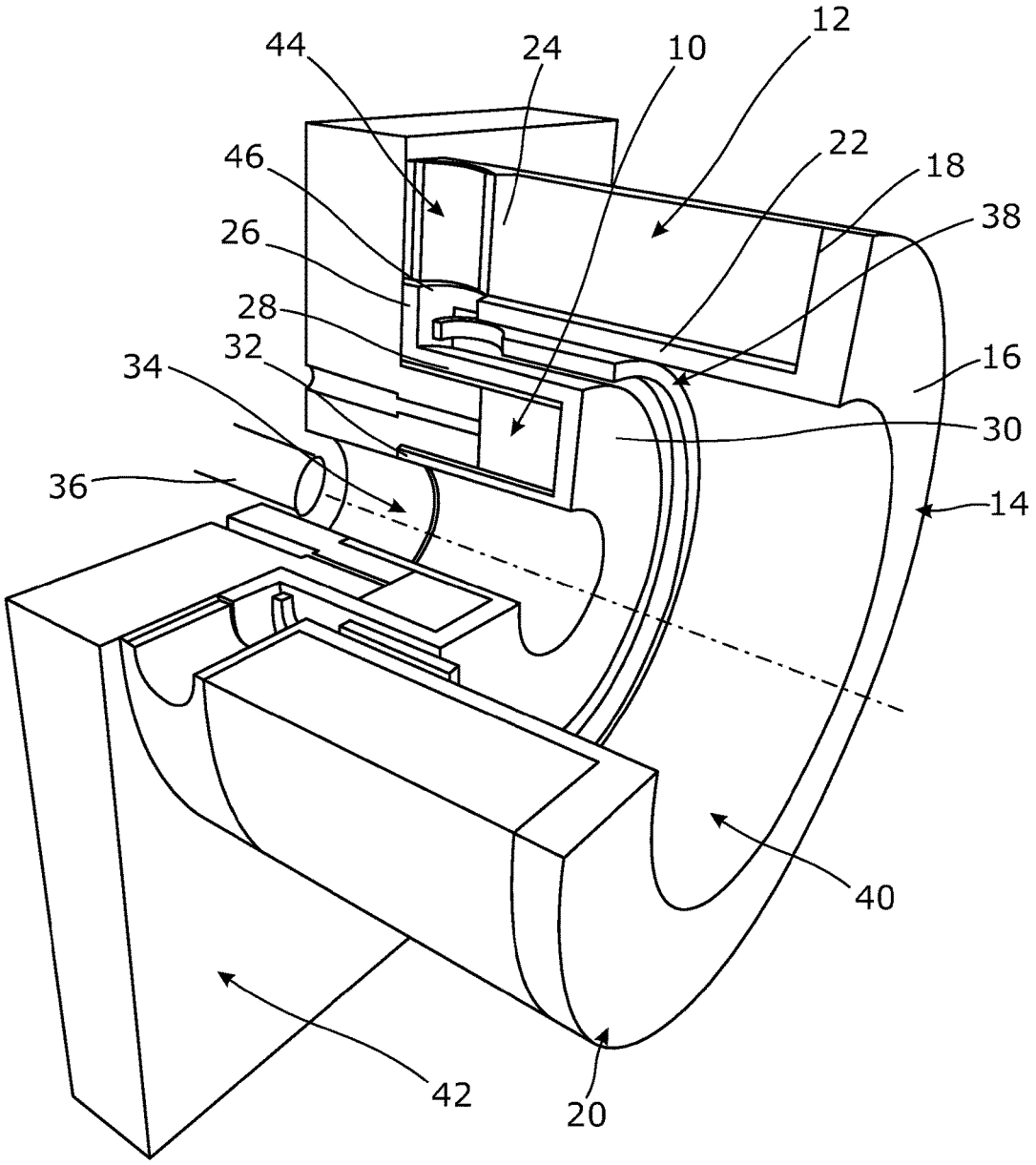
FIG. 1 is a partially cut-away perspective view of an ion accelerator according to an embodiment of the invention.

Referring to FIG. 1, an ion accelerator, which in this case forms part of a plasma thruster, comprises an inner magnet 10 and an outer magnet 12. Each of the magnets 10, 12 is in the form of a hollow cylinder or tube, and the magnets are arranged coaxially with the inner one 10 being located inside the outer one 12. The inner and outer magnets overlap in the axial direction so that the outer magnet 12 surrounds a part, and in the embodiment shown, all, of the inner magnet 10. A housing 14 supports the magnets 10, 12 and comprises an outer annular wall 16 which covers the annular end 18 of the outer magnet 12 at the front end 20 of the thruster, an outer cylindrical wall 22 which is just inside the outer magnet 12 and extends along its length beyond its rear end 24, a rear annular wall 26 extending inwards from the rear end of the outer cylindrical wall 22, a middle cylindrical wall 28 extending forwards from the inner edge of the rear annular wall 26 and extending along the outer surface of the inner magnet 10, an inner annular wall 30 extending inwards from the front end of the middle cylindrical wall 28, covering the front end of the inner magnet 10, and an inner cylindrical wall 32 extending rearwards from the inner edge of the inner annular wall along the inner surface of the inner magnet 10. The inner cylindrical wall 32 surrounds and defines within it a channel 34 which extends through the centre of the inner magnet 12, and a hollow cathode 36 is located at the rear end of the channel and arranged to generate plasma and introduce it into the channel 34. A tubular anode 38 is located in the space between the outer and middle cylindrical walls 22, 28, with its front end just forward of the front end of the inner magnet 10, and well behind the front end of the outer magnet 12. The anode, or the tubular portion of it, has an inner diameter greater than the outer diameter of the inner magnet 10, and an outer diameter less than the inner diameter of the outer magnet 12. The cathode 36 and anode 38 are arranged to set up the electrostatic field required for the accelerator to operate as described below. In other embodiments the cathode for providing the electrostatic field can be separate from the plasma source.

The rear ends of the two magnets 10, 12 are aligned with each other in the axial direction, and the outer magnet 12 is longer than the inner magnet 10 and extends forward of the front end of the inner magnet. The region inside the front end of the outer magnet 12 and forward of the inner magnet 10 forms a chamber 40 in which plasma generation and ion acceleration takes place as will be described in more detail below. The housing 14 shields the magnets 10, 12 from the channel 34 and plasma chamber 40. At the rear end of the accelerator a heat sink 42, in this case in the form of a copper block, is located against, and in thermal contact with, the rear end of the housing 14 and the rear ends of the inner and outer magnets 10,12. The heat sink 42 has an aperture through which the hollow cathode 36 can be inserted and through which gas can be supplied to the hollow cathode 36. Four propellant channels 44 are provided extending radially through the heat sink 42 and connect to apertures 46 in the housing, in the rear end of the outer cylindrical wall 22. As the anode 38 is spaced from the outer and middle cylindrical walls 22, 28, propellant introduced into these propellant channels 44 can flow into the space between the outer and middle cylindrical walls 22, 28, and therefore between the inner and outer magnets 10, 12, past the anode 38, and into the main plasma chamber 40.

In operation, the general principle of the accelerator is similar to known accelerators. The anode 38 and cathode 36 set up an electric field which accelerates electrons and ions in the plasma chamber 40. The accelerated electrons ionize the propellant introduced into the chamber 40 producing positive ions and further secondary electrons. The electrons, because of their relatively high charge to mass ratio, are deflected by the magnetic field in the chamber and tend to follow the magnetic field, while the positive ions are relatively unaffected by the magnetic field and therefore tend to travel in a direction dictated by the electric field.

Figure 2:
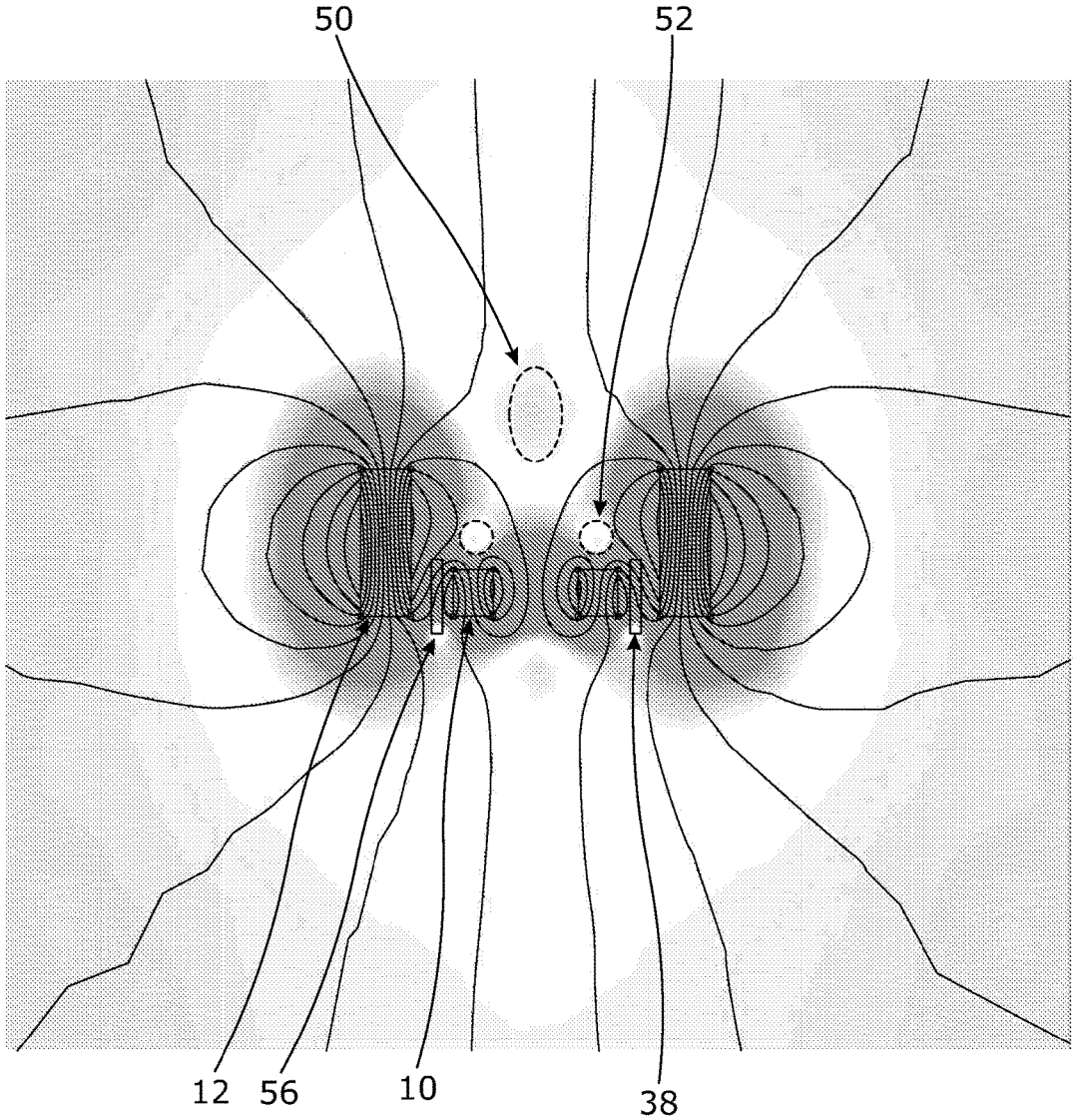
FIG. 2 is a diagram of the magnetic field in the accelerator of FIG. 1.

Referring to FIG. 2, the polarities of the inner and outer magnets 10, 12 are in the same direction. For example if the front end of the outer magnet 12 is its north pole and the rear end is its south pole, then the front end of the inner magnet 10 is also its north pole, and the rear end is its south pole. The polarities are therefore opposed to each other, and not complementary as they would be if the polarities were opposite to each other. This sets up a complex magnetic field having a point 50 of zero magnetic field located on the central axis of the accelerator and forward of the front end of the outer magnet 12, and a line 52 of zero magnetic field that is circular and extends around the central axis just forward of the front end of the inner magnet 10. A similar zero point 54 and zero line 56 are set up to the rear of the magnets 10, 12 but these are not relevant to the operation of the accelerator.

As is well understood by those skilled in the art, in a plasma, magnetic fields act as an electrical resistance to electrons trying to move perpendicular to them, as the electrons are deflected by the magnetic field, but lines which do not have significant magnetic field perpendicular to them have low electrical 'resistance' and therefore can be considered to act as 'conductors' as electrons can move relatively freely along them. Therefore it will be appreciated that the zero point 50 at the forward end of the accelerator is held at an electrical potential close to that of the cathode, because of the 'channel' of low transverse magnetic field between it and the cathode. Similarly the line 52 of zero magnetic field is held at a similar electrical potential to the anode, as there is little magnetic field transverse to the direction between them and a similar 'channel' of low transverse field can be seen between the front end of the anode 38 and the zero line 52, so electrons can move relatively freely between them.

Another effect that is well known to those skilled in the art and relevant to the operation of the accelerator is that a high degree of ionization, and therefore a high density of ions, tends to occur at points of zero magnetic field. This is because the magnetic field around such points tends to enclose the electrons and prevent them from moving away.

In the accelerator shown, when it is in operation, plasma is introduced into the channel 34 from the hollow cathode and the electrons and ions are accelerated due to the electric fields in the channel and plasma chamber 40. The electrons tend to cause further ionisation of any propellant that is added into the plasma chamber 40 thereby replacing any ions and electrons that leave the chamber. The positively charged ions accelerate towards regions of low electrical potential. As there is a lot of ionisation taking place in the region of the zero field line 52, a large number of positive ions are accelerated from the region around that line, which is in the shape of a torus, towards the zero field point 50. This forms a converging stream of ions moving towards the front end of the accelerator. As the electric field strength in front of the zero point 50 is relatively weak, the positive ions are not significantly decelerated after passing the zero point 50 and form a continuous stream of ions ejected forwards from the front end of the accelerator. Meanwhile electrons gradually move towards the anode 38 and are collected there.

While this arrangement can be used to generate ion beams for many applications, in this embodiment as the accelerator forms part of an ion thruster, propellant can be introduced into the plasma chamber 40 via the inlet channels 44 during operation of the accelerator to keep up a continuous beam of ions which produce thrust. Other configurations of propellant supply could of course also be used. In other applications of the ion accelerator, the hollow cathode may be able to provide sufficient plasma and a separate supply of gas for ionisation may not be necessary.

In still further embodiments, the hollow cathode is replaced by a simple cathode and the only supply of gas is via the inlet channels 44.

It will be noticed that the magnetic field forward of the zero point 50 is in approximately parallel to the direction of travel of the ion beam. This helps to contain the ion beam as the positive ions tend to follow the magnetic field direction, though to a much lesser extent than the electrons due to the difference in charge to mass ratio.

It will be appreciated that the geometry of the accelerator can be modified in many ways. For example the zero point 50 and zero line 52 at the front end of the accelerator are spaced apart in the axial (forward/backward) direction much more than those 54, 56 to the rear of the accelerator. This is because the front ends of the inner and outer magnets 10, 12 are not level, in the axial direction, with the front end of the outer magnet 12 being forward of the front end of the inner magnet 10, whereas their rear ends are level in the axial direction. It will be understood that the relative lengths and axial positioning of the two magnets, and their relative size, can be selected so as to achieve the axial spacing of the two regions of zero magnetic field and their relative size, suitable for a particular application. For example the inner and outer magnets can in some cases be of equal length. In some cases their front ends can be approximately level in the axial direction. However this means that the axial offset between the two zero field regions will be less than in the embodiment of FIG. 1.

Figure 3:
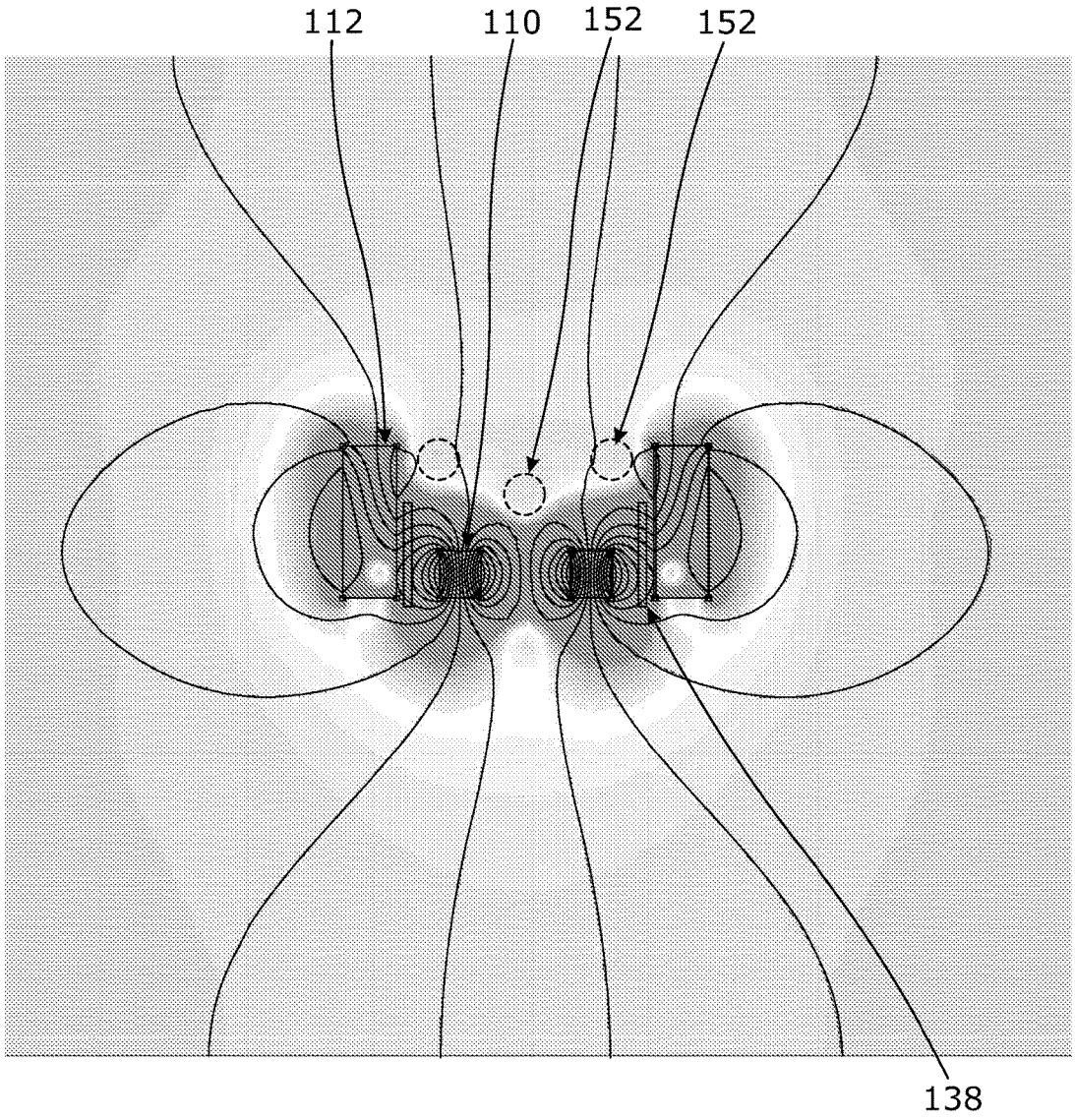
FIG. 3 is a diagram of the magnetic field in an accelerator of a second embodiment of the invention.

Referring to FIG. 3, in a further embodiment the positions of the inner and outer magnets 110, 112 is the same as that of the first embodiment, but the relative strengths is different, in this case the inner magnet being stronger than the outer magnet. This results in a magnetic field pattern that still includes a zero point 150 on the central axis of the accelerator and a zero line 152 in the form of a ring around that axis, but in this case the ring is forward of the point 152. Therefore, for the accelerator to accelerate positive ions in the forward direction, the electrode 138 that is radially between the inner and outer magnets 110, 112, is the cathode, and an anode is placed on or around the central axis and radially inside the inner magnet 110. The resultant ion beam is divergent which may be desirable in some circumstances.

The invention claimed is:

1. An ion accelerator comprising: a coaxial magnetic arrangement having:

an inner magnet having a channel extending through the inner magnet in an axial direction; and an outer magnet extending around the inner magnet, the inner magnet and the outer magnet having like polarities so that the coaxial magnetic arrangement produces a magnetic field having two locations of zero magnetic field strength, the two locations being spaced apart in the axial direction; and an anode and a cathode arranged to generate an electrical potential difference between the two locations, wherein one location of the two locations of zero magnetic field strength is a point surrounded by a region of non-zero magnetic field along a central axis of the channel.

2. The ion accelerator according to claim 1, wherein the other location of the two locations of zero magnetic field strength is a line that extends around the central axis.

3. The ion accelerator according to claim 1, wherein the location of the two locations that is the point is forward of the location of the two locations that is not the point, so that ions will tend to converge when moving between the two locations.

4. The ion accelerator according to claim 1, wherein the point is forward of a front end of the inner magnet of the coaxial magnetic arrangement.

5. The ion accelerator according to claim 1, wherein the point is forward of a front end of the outer magnet of the coaxial magnetic arrangement.

6. The ion accelerator according to claim 2, wherein the line is rearward of a front end of the outer magnet of the coaxial magnetic arrangement.

7. The ion accelerator according to claim 1, comprising: plural electrodes, wherein one electrode of the plural electrodes is located radially between the inner magnet and outer magnet of the coaxial magnetic arrangement.

8. The ion accelerator according to claim 1, comprising: plural electrodes, wherein one electrode of the plural electrodes is located radially inside the inner magnet of the coaxial magnetic arrangement.

9. The ion accelerator according to claim 1, wherein a front end of the outer magnet of the coaxial magnetic arrangement is forward of a front end of the inner magnet of the coaxial magnetic arrangement.

10. The ion accelerator according to claim 1, wherein a front end of the outer magnet of the coaxial magnetic arrangement is forward of a front end of the anode.

11. An ion thruster comprising: an ion accelerator according to claim 1; and a propellant source arranged to feed propellant into the ion accelerator.

12. The ion thruster according to claim 11, wherein the propellant source is arranged to feed propellant to the cathode of the ion accelerator.

13. The ion thruster according to claim 11, wherein the propellant source is arranged to feed propellant into a space between the inner magnet and outer magnet of the coaxial magnetic arrangement.

* * * * *